US009834015B2

(12) United States Patent
Shinohara et al.

(10) Patent No.: US 9,834,015 B2
(45) Date of Patent: Dec. 5, 2017

(54) PRINTING MACHINE

(71) Applicant: RISO KAGAKU CORPORATION, Tokyo (JP)

(72) Inventors: Masaaki Shinohara, Ibaraki (JP); Tomohiko Shimoda, Ibaraki (JP); Tetsunori Saito, Ibaraki (JP); Kazuyuki Aoki, Ibaraki (JP); Takuya Okamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/067,873

(22) Filed: Mar. 11, 2016

(65) Prior Publication Data

US 2016/0288545 A1 Oct. 6, 2016

(30) Foreign Application Priority Data

Mar. 30, 2015 (JP) ..... 2015-068103

(51) Int. Cl.
*B65H 29/00* (2006.01)
*B41J 13/00* (2006.01)
(Continued)

(52) U.S. Cl.
CPC ..... *B41J 13/0045* (2013.01); *B41J 3/60* (2013.01); *B65H 5/062* (2013.01); *B65H 5/36* (2013.01)

(58) Field of Classification Search
CPC ..... B65H 2404/651; B65H 2301/33; B65H 2301/332; B65H 2301/16;
(Continued)

(56) References Cited

U.S. PATENT DOCUMENTS 8,408,537 B2 * 4/2013 Katada ..... B41J 13/0045 271/184
8,503,922 B2 8/2013 Maeda et al.
(Continued)

FOREIGN PATENT DOCUMENTS

JP 2009-46303 3/2009

OTHER PUBLICATIONS

Search Report issued in European Patent Office (EPO) Patent Application No. 16161361.7, dated Aug. 22, 2016.

*Primary Examiner* — Thomas Morrison
(74) *Attorney, Agent, or Firm* — Greenblum & Bernstein, P.L.C.

(57) ABSTRACT

A printing machine includes a printing unit which performs printing while transferring a sheet at a printing transfer speed, a circulation transfer unit which receives the sheet after simplex printing and transfers the sheet by reversing the sheet upside down, during duplex printing; and a paper refeed unit which refeeds, to the printing unit, the sheet transferred by the circulation transfer unit after simplex printing, wherein the circulation transfer unit includes a reversing unit which receives the sheet at the printing transfer speed, reverses the sheet upside down by switching back the sheet and accelerates the sheet up to a circulation transfer speed which is higher than the printing transfer speed when sheet transfer is restarted after temporal stop in the switching back, and a horizontal transfer unit which transfers the sheet switched back by the reversing unit, at the circulation transfer speed.

2 Claims, 3 Drawing Sheets

(51) Int. Cl.
*B41J 3/60* (2006.01)
*B65H 5/06* (2006.01)
*B65H 5/36* (2006.01)

(58) Field of Classification Search
CPC ..... B65H 2301/333; B65H 2301/4211; B65H 29/58; B65H 29/60; B65H 31/00; B65H 2301/33214; B65H 2301/33224; B65H 2301/3331; B65H 2403/80; B65H 2513/108; B65H 2513/20; B65H 7/20; B41J 13/0045
See application file for complete search history.

(56) References Cited

U.S. PATENT DOCUMENTS

| | | | | |
|---|---|---|---|---|
| 2005/0251286 | A1* | 11/2005 | Yasui | G03G 15/231 700/230 |
| 2010/0014884 | A1 | 1/2010 | Roppongi | |
| 2010/0183353 | A1* | 7/2010 | Katada | B41J 13/0045 400/611 |
| 2015/0009258 | A1 | 1/2015 | Moriyama | |

* cited by examiner

PRINTING MACHINE

TECHNICAL FIELD

The present invention relates to a printing machine which performs printing on a sheet.

RELATED ART

There is known a printing machine which performs duplex printing.

As the printing machine which performs duplex printing, there is disclosed a printing machine of the type which performs printing on one surface of the sheet by a printing unit configured to perform printing while transferring the sheet by a transfer belt and which then performs printing on the other surface of the sheet by reversing the sheet upside down and refeeding the sheet to the printing unit while transferring the sheet along a circulation route, in Patent Document 1.

The printing machine disclosed in Patent Document 1 realizes high productivity by performing duplex printing at productivity per simplex printing which is equivalent to productivity during simplex printing. In order to realize the above-mentioned productivity in various sheet sizes, in the printing machine disclosed in Patent Document 1, there is provided, in the circulation route, a high-speed section in which the sheet is transferred at a circulation transfer speed which is higher than a printing transfer speed which is a transfer speed in the printing unit. The circulation transfer speed is set in accordance with each sheet size. Thereby, refeeding is possible at a timing according to the productivity in the printing unit.

In the high-speed section in the circulation route of the printing machine disclosed in Patent Document 1, a roller pair which transfers the sheet while nipping the sheet is driven at the circulation transfer speed. In the circulation route, the sheet is transferred at the printing transfer speed until the sheet reaches the high-speed section. When the sheet reaches the high-speed section, the sheet is pulled out from a roller pair in an upstream-side section in which the sheet is transferred at the printing transfer speed by the roller pair in the high-speed section. Thereby, the sheet is accelerated from the printing transfer speed to the circulation transfer speed.

The sheet accelerated is transferred at the circulation transfer speed in the high-speed section and then is reversed upside down by being switched back on the downstream side of the high-speed section. Then, the sheet reversed upside down is refed to the printing unit.

Patent Document 1: Japanese Patent Application Laid-Open Publication No. 2009-46303

SUMMARY

However, in the printing machine disclosed in Patent Document 1, since acceleration is performed by pulling out the sheet from the roller pair in an upstream-side section by the roller pair in the high-speed section, a heavy load is imposed on the sheet and the roller pairs. When the heavy load is imposed on the sheet and the roller pairs, the sheets may be damaged and the roller may be easily deteriorated.

The present invention has been made in view of the above problem. An object of the present invention is to provide a printing machine that can reduce the load on a sheet and a sheet transfer mechanism.

In order to attain the above-mentioned object, a printing machine according to the present invention includes a printing unit which performs printing while transferring a sheet at a printing transfer speed, a circulation transfer unit which receives the sheet after simplex printing and transfers the sheet by reversing the sheet upside down, during duplex printing; and a paper refeed unit which refeeds, to the printing unit, the sheet transferred by the circulation transfer unit after simplex printing, wherein the circulation transfer unit includes a reversing unit which receives the sheet at the printing transfer speed, reverses the sheet upside down by switching back the sheet and accelerates the sheet up to a circulation transfer speed which is higher than the printing transfer speed when sheet transfer is restarted after temporal stop in the switching back, and a high-speed transfer unit which transfers the sheet switched back by the reversing unit, at the circulation transfer speed.

Furthermore, in the printing machine according to the present invention, the reversing unit may be configured to switch back the sheet and to accelerate the sheet up to the circulation transfer speed, by a single roller pair.

BRIEF DESCRIPTION OF DRAWINGS

The invention will now be described with reference to the accompanying drawings wherein.

DETAILED DESCRIPTION

Figure 1:
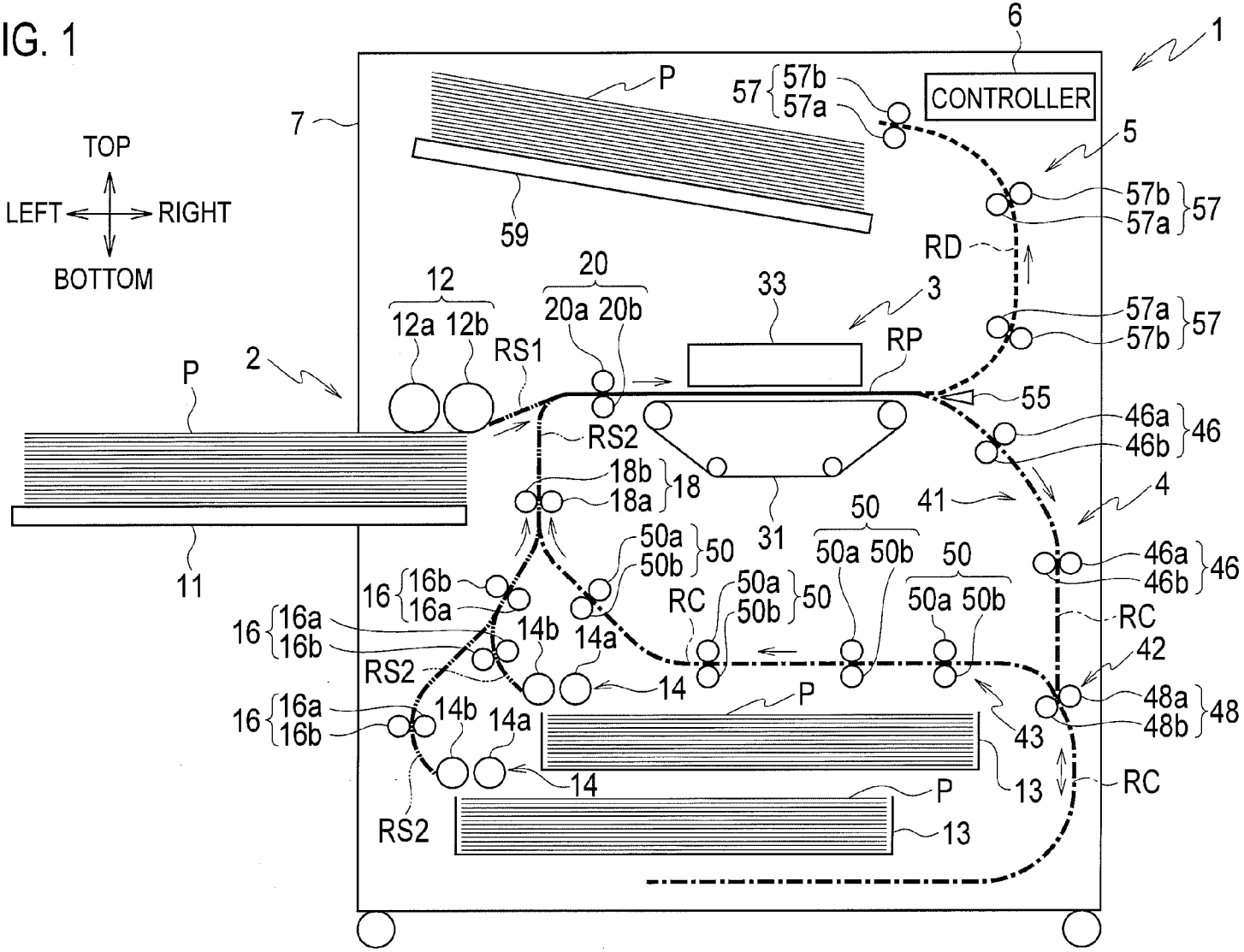
FIG. 1 is a schematic configuration diagram of a printing machine according to an embodiment.

An embodiment of the present invention will be described below with reference to the drawings. The same or equivalent numerals are attached to the same or equivalent portions and constitutional elements in the drawings.

The embodiment which will be described in the following merely illustrates a device and the like for embodying technical ideas of the present invention, and the technical ideas of the present invention do not specify a material quality, a shape, a structure, an arrangement and the like of each constituent component as ones which will be described below. The technical ideas of the present invention can be variously modified within a range of the scope of patent claims.

Figure 2:
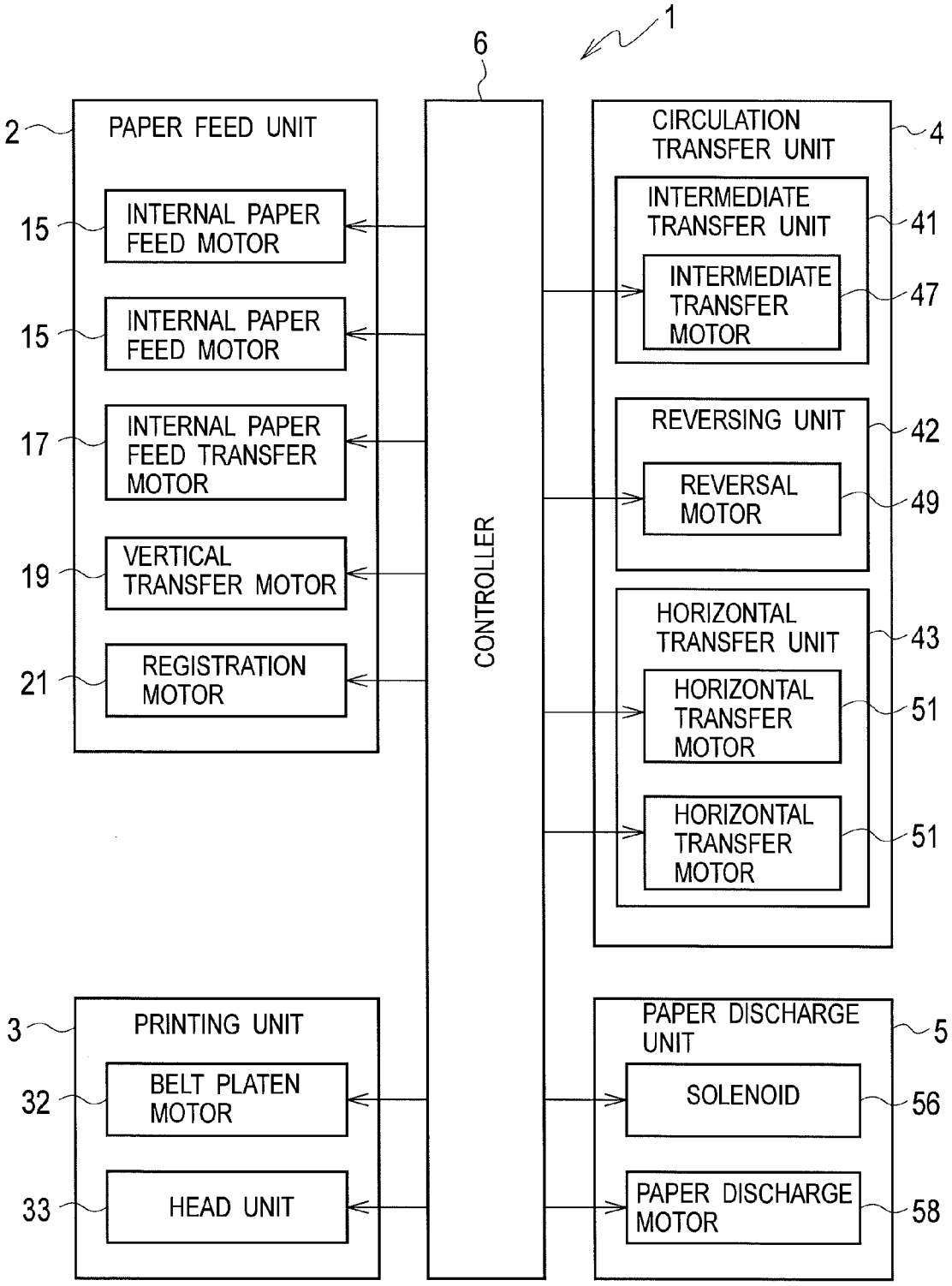
FIG. 2 is a control block diagram of the printing machine illustrated in FIG. 1.

FIG. 1 is a schematic configuration diagram of a printing machine according to an embodiment of the present invention. FIG. 2 is a control block diagram of the printing machine illustrated in FIG. 1. In the following description, a direction orthogonal to the plane of paper in FIG. 1 will be referred to as a front-back direction and a paper plane front direction will be referred to as the front. In addition, the top and bottom and the left and right of the paper plane in FIG. 1 will be respectively referred to as a top-bottom direction and a left-right direction.

In FIG. 1, a route indicated with a thick line is a transfer route along which a sheet which is a printing medium is to be transferred. In the transfer route, a solid line route is a printing route RP, a dashed line route is a circulation route RC, a broken line route is a paper discharge route RD and two-dot chain lines are, respectively, an external paper feed route RS1 and an internal paper feed route RS2. The upstream and the downstream in the following explanation respectively mean the upstream and the downstream of the transfer route.

As illustrated in FIGS. 1 to 2, a printing machine 1 according to the present embodiment includes a paper feed unit 2, a printing unit 3, a circulation transfer unit 4, a paper discharge unit 5, a controller 6, a housing 7 which houses or holds respective units.

The paper feed unit 2 (a paper refeed unit) feeds the sheet P on which printing is not yet performed to the printing unit 3. Furthermore, the paper feed unit 2 refeeds the sheet P after simplex printing to the printing unit 3, during duplex printing. The paper feed unit 2 is arranged on the most upstream side of the transfer route. The paper feed unit 2 includes an external paper feed tray 11, an external paper feed roller pair 12, two internal paper feed trays 13, two internal paper feed roller pairs 14, two internal paper feed motors 15, three internal paper feed transfer roller pairs 16, an internal paper feed transfer motor 17, a vertical transfer roller pair 18, a vertical transfer motor 19, a registration roller pair 20, and a registration motor 21.

The external paper feed tray 11 is a tray on which the sheets P used for printing are to be stacked. The external paper feed tray 11 is installed so as to be partially exposed to the outside of the housing 7.

The external paper feed roller pair 12 takes out the sheets P stacked on the external paper feed tray 11 one by one and transfers the sheets P taken out to the registration roller pair 20 one by one. The external paper feed roller pair 12 includes a scraper roller 12*a* and a pick-up roller 12*b*.

The scraper roller 12*a* separates the highest-order (the uppermost) sheet P from the sheets P stacked on the external paper feed tray 11. The scraper roller 12*a* is arranged above a right end part of the external paper feed tray 11.

The pick-up roller 12*b* strips the sheet P separated by the scraper roller 12*a* from the sheets P stacked on the external paper feed tray 11, between a not illustrated stripper plate and the scraper roller 12*a*, and transfers the sheet P rightwards. The pick-up roller 12*b* is arranged adjacent to the downstream side (the right-hand side) of the scraper roller 12*a*.

The internal paper feed tray 13 is a tray on which the sheets P used for printing are to be stacked. The internal paper feed tray 13 is arranged within the housing 7.

The internal paper feed roller pairs 14 each takes out the sheets P stacked on the internal paper feed tray 13 one by one and transfers the sheets P so taken out to the internal paper feed transfer roller pairs 16. The internal paper feed roller pair 14 includes a scraper roller 14*a* and a pick-up roller 14*b*.

The scraper roller 14*a* separates the highest-order sheet P from the sheets P stacked on the internal paper feed tray 13. The scraper roller 14*a* is arranged above a left end part of the internal paper feed tray 13.

The pick-up roller 14*b* strips the sheet P separated by the scraper roller 14*a* from the sheets P stacked on the internal paper feed tray 13, between a not illustrated stripper plate and the scraper roller 14*a*, and transfers the sheet P leftwards. The pick-up roller 14*b* is arranged adjacent to the downstream side (the left-hand side) of the scraper roller 14*a*.

Each of the two internal paper feed motors 15 drives an internal paper feed roller pair 14.

Each of the internal paper feed transfer roller pairs 16 transfers the sheet P taken out from the internal paper feed tray 13 by the internal paper feed roller pair 14, to the vertical transfer roller pair 18. The internal paper feed transfer roller pairs 16 are arranged along the internal paper feed route RS2.

The internal paper feed transfer roller pair 16 is constituted by a pair of internal paper feed transfer rollers 16*a* and 16*b*. The internal paper feed transfer roller pair 16 transfers the sheet P while nipping the sheet P between the internal paper feed transfer rollers 16*a* and 16*b*.

The internal paper feed transfer motor 17 drives the three internal paper feed transfer roller pairs 16.

The vertical transfer roller pair 18 transfers the sheet P transferred by the internal paper feed transfer roller pairs 16 along the internal paper feed route RS2, to the registration roller pair 20. Furthermore, the vertical transfer roller pair 18 transfers the sheet P after simplex printing, transferred along the circulation route RC, to the registration roller pair 20, during duplex printing. The vertical transfer roller pair 18 is arranged along the internal paper feed route RS2 on the downstream side of a spot where the circulation route RC joins the internal paper feed route RS2.

The vertical transfer roller pair 18 is constituted by a pair of vertical transfer rollers 18*a* and 18*b*. The vertical transfer roller pair 18 transfers the sheet P while nipping the sheet P between the vertical transfer rollers 18*a* and 18*b*. A printing surface of the sheet P after simplex printing comes into contact with the right-hand side vertical transfer roller 18*a* in the vertical transfer rollers 18*a* and 18*b*, during duplex printing. Therefore, the vertical transfer roller 18*a* is composed of a roller subjected to antifouling treatment. For example, the vertical transfer roller 18*a* is composed of a roller the surface of which is coated with ceramic powder. The vertical transfer roller 18*b* is composed of a roller not subjected to antifouling treatment.

The vertical transfer motor 19 drives the vertical transfer roller pair 18. Furthermore, the vertical transfer motor 19 drives the external paper feed roller pair 12. The vertical transfer motor 19 is connected to the vertical transfer roller pair 18 and the external paper feed roller pair 12, respectively, via not illustrated one-way clutches. Thereby, the vertical transfer roller pair 18 is driven by rotation of the vertical transfer motor 19 in one direction and the external paper feed roller pair 12 is driven by rotation of the vertical transfer motor 19 in the other direction.

The registration roller pair 20 temporarily stops movement of the sheet P which has been transferred by the external paper feed roller pair 12 or the vertical transfer roller pair 18 and corrects skew of the sheet P, and then transfers the sheet P to a belt platen 31 of the later described printing unit 3. The registration roller pair 20 is arranged on the printing route RP in the vicinity of the downstream side of a spot where the external paper feed route RS1 joins the internal paper feed route RS2.

The registration roller pair 20 is constituted by a pair of registration rollers 20*a* and 20*b*. The registration roller pair 20 transfers the sheet P while nipping the sheet P between the registration rollers 20*a* and 20*b*. The printing surface of the sheet P after simplex printing comes into contact with the lower-side registration roller 20*b* in the registration rollers 20*a* and 20*b*, during duplex printing. Therefore, the registration roller 20*b* is composed of a roller subjected to antifouling treatment. The registration roller 20*a* is composed of a roller not subjected to antifouling treatment.

The registration motor 21 drives the registration roller pair 20.

The printing unit 3 prints an image on the sheet P while transferring the sheet P. The printing unit 3 is arranged on the downstream side of the paper feed unit 2. The printing unit 3 includes the belt platen 31, a belt platen motor 32, and a head unit 33.

The belt platen 31 transfers the sheet P transferred by the registration roller pair 20 at a printing transfer speed Vg while sucking and retaining the sheet P on its own belt. The belt platen 31 is arranged on the downstream side of the registration roller pair 20.

The belt platen motor 32 drives the belt of the belt platen 31.

The head unit 33 ejects ink onto the sheet P transferred by the belt platen 31 and prints an image on the sheet P. The head unit 33 is arranged above the belt platen 31. The head unit 33 includes a plurality of inkjet heads (not illustrated) with a plurality of nozzles being arrayed along a direction (a front-back direction) which is orthogonal to a transfer direction of the sheet P. The head unit 33 ejects ink from the nozzles of the inkjet heads.

The circulation transfer unit 4 transfers the sheet P after simplex printing along the circulation route RC and delivers the sheet P to the vertical transfer roller pair 18, during duplex printing. The circulation route RC is a route which descends from a downstream end of the printing route RP, passes under the belt platen 31 and joins with the internal paper feed route RS2 in the vicinity of the upstream side of the vertical transfer roller pair 18. The circulation transfer unit 4 includes an intermediate transfer unit 41, a reversing unit 42, and a horizontal transfer unit 43 (a high-speed transfer unit).

The intermediate transfer unit 41 transfers the sheet P after simplex printing from the belt platen 31 to the reversing unit 42 at the printing transfer speed Vg, during duplex printing. The intermediate transfer unit 41 is arranged on the downstream side of the belt platen 31. The intermediate transfer unit 41 includes two intermediate transfer roller pairs 46, and an intermediate transfer motor 47.

Each of the intermediate transfer roller pairs 46 receives, at the printing transfer speed Vg, the sheet P sent from the belt platen 31 after simplex printing and transfers the sheet P to a later described reversal roller pair 48 at the printing transfer speed Vg. The two intermediate transfer roller pairs 46 are arranged along the circulation route RC between the belt platen 31 and the reversal roller pair 48.

The intermediate transfer roller pairs 46 each is constituted by a pair of intermediate transfer rollers 46*a* and 46*b*. The intermediate transfer roller pairs 46 each transfers the sheet P while nipping the sheet P between the intermediate transfer rollers 46*a* and 46*b*. The printing surface of the sheet P after simplex printing comes into contact with the right-hand side intermediate transfer roller 46*a* in the intermediate transfer rollers 46*a* and 46*b*, during duplex printing. Therefore, the intermediate transfer roller 46*a* is composed of a roller subjected to antifouling treatment. The intermediate transfer roller 46*b* is composed of a roller not subjected to antifouling treatment.

The intermediate transfer motor 47 drives the two intermediate transfer roller pairs 46. Furthermore, the intermediate transfer motor 47 drives later described two paper discharge roller pairs 57.

The reversing unit 42 reverses the sheet P upside down after simplex printing. The reversing unit 42 is arranged on the downstream side of the intermediate transfer unit 41. The reversing unit 42 includes the reversal roller pair 48, and a reversal motor 49.

The reversal roller pair 48 receives, at the printing transfer speed Vg, the sheet P transferred by the intermediate transfer roller pair 46, reverses the sheet P upside down by switching back the sheet P, accelerates the sheet P up to a circulation transfer speed Vr and delivers the sheet P to the horizontal transfer unit 43. The reversal roller pair 48 is arranged on the downstream side of the intermediate transfer roller pairs 46 along the circulation route RC. The circulation transfer speed Vr is a transfer speed of the sheet P in the horizontal transfer unit 43. The circulation transfer speed Vr is higher than the printing transfer speed Vg.

The reversal roller pair 48 is constituted by a pair of reversal rollers 48*a* and 48*b*. The reversal roller pair 48 transfers the sheet P while nipping the sheet P between the reversal rollers 48*a* and 48*b*. The printing surface of the sheet P after simplex printing comes into contact with the right-hand side reversal roller 48*a* in the reversal rollers 48*a* and 48*b*, during duplex printing. Therefore, the reversal roller 48*a* is composed of a roller subjected to antifouling treatment. The reversal roller 48*b* is composed of a roller not subjected to antifouling treatment.

The reversal motor 49 drives the reversal roller pair 48 in normal and reverse rotation directions. Normal rotation drive is a drive which rotates the reversal rollers 48*a* and 48*b* in a direction in which the reversal roller pair 48 transfers the sheet P downwards. Reverse rotation drive is a drive which rotates the reversal rollers 48*a* and 48*b* in a direction in which the reversal roller pair 48 transfers the sheet P upwards.

The horizontal transfer unit 43 transfers the sheet P switched back by the reversing unit 42, to the vertical transfer roller pair 18 of the paper feed unit 2. The horizontal transfer unit 43 is arranged on the downstream side of the reversing unit 42. The horizontal transfer unit 43 includes four horizontal transfer roller pairs 50, and two horizontal transfer motors 51.

Each of the horizontal transfer roller pairs 50 receives the sheet P from the reversal roller pair 48 at the circulation transfer speed Vr, and transfers the sheet P to the vertical transfer roller pair 18 at the circulation transfer speed Vr. The three upstream-side horizontal transfer roller pairs 50 are arranged along a horizontal section of the circulation route RC under the belt platen 31. The most downstream-side horizontal transfer roller pair 50 is arranged along an ascending section on the downstream side of the horizontal section of the circulation route RC.

Each of the horizontal transfer roller pairs 50 is constituted by a pair of horizontal transfer rollers 50*a* and 50*b*. Each of the horizontal transfer roller pairs 50 transfers the sheet P while nipping the sheet P between the horizontal transfer rollers 50*a* and 50*b*. The printing surface of the sheet P after simplex printing comes into contact with the upper side horizontal transfer roller 50*a* in the horizontal transfer rollers 50*a* and 50*b*, during duplex printing. Therefore, the horizontal transfer roller 50*a* is composed of a roller subjected to antifouling treatment. The horizontal transfer roller 50*b* is composed of a roller not subjected to antifouling treatment.

One of the two horizontal transfer motors 51 drives the two upstream-side horizontal transfer roller pairs 50. The other horizontal transfer motor 51 drives the two downstream-side horizontal transfer roller pairs 50.

The paper discharge unit 5 receives the printed sheet P from the printing unit 3, transfers the sheet P along the paper discharge route RD and discharges the sheet P. The paper discharge unit 5 includes a switching unit 55, a solenoid 56, the three paper discharge roller pairs 57, a paper discharge motor 58, and a paper receiving tray 59.

The switching unit 55 switches the transfer route of the sheet P, between the paper discharge route RD and the circulation route RC. The switching unit 55 is arranged on a spot corresponding to a downstream end of the printing route RP and upstream ends of the paper discharge route RD and the circulation route RC. The paper discharge route RD is a route which ascends from the downstream end of the printing route RP and extends to the paper receiving tray 59.

The solenoid 56 drives the switching unit 55.

Each of the paper discharge roller pairs 57 each receives and transfers the sheet P transferred from the belt platen 31, and discharges the sheet P onto the paper receiving tray 59. The paper discharge roller pairs 57 are arranged along the paper discharge route RD.

The paper discharge roller pairs 57 each is constituted by a pair of paper discharge rollers 57*a* and 57*b*. Each of the paper discharge roller pairs 57 transfers the sheet P while nipping the sheet P between the paper discharge rollers 57*a* and 57*b*. One surface and the other surface of the sheet P subjected to duplex printing, respectively, come into contact with the paper discharge rollers 57*a* and 57*b*. Therefore, both of the paper discharge rollers 57*a* and 57*b* are composed of rollers subjected to antifouling treatment.

The paper discharge motor 58 drives the most downstream-side paper discharge roller pair 57. Note that the two upstream-side paper discharge roller pairs 57 are driven by the intermediate transfer motor 47.

The paper receiving tray 59 is a tray obtained by stacking the sheets P discharged by the paper discharge roller pairs 57. The paper receiving tray 59 is arranged on a downstream end of the paper discharge route RD.

The controller 6 controls operations of respective units of the printing machine 1. The controller 6 is constituted by including a CPU, a RAM, a ROM, a hard disk and the like.

Next, the operation of the printing machine 1 during simplex printing will be described.

First, the controller 6 causes the belt platen motor 32 to start driving of the belt platen 31. The controller 6 performs control such that the transfer speed of the sheet P by the belt platen 31 reaches the printing transfer speed Vg. Here, the printing transfer speed Vg is set on the basis of: a maximum number of drops per pixel which is defined in accordance with each sheet type and the like; printing resolution; and the like.

Furthermore, the controller 6 causes the intermediate transfer motor 47 and the paper discharge motor 58 to start driving of the three paper discharge roller pairs 57.

Next, the controller 6 controls the paper feed unit 2 so as to feed the sheets P to the printing unit 3 every print time Tps for single-sheet printing in the printing unit 3.

The print time Tps for single-sheet printing in the printing unit 3 is expressed by the following Numerical formula.

$$T_{ps} = \frac{L_p + L_g}{V_g} \quad \text{[Numerical formula 1]}$$

Here, Lp is a sheet length and Lg is an inter-sheet distance.

The sheet length Lp is a length in the transfer direction of the sheet P. The sheet length Lp is determined in accordance with each sheet size.

The inter-sheet distance Lg is a distance between a trailing end of the preceding sheet P and a leading end of the succeeding sheet P on the belt platen 31 in the transfer direction of the sheets P. The shorter the inter-sheet distance Lg is, the larger the number of sheets to be output per unit time becomes. In the present embodiment, the inter-sheet distance Lg is set to a minimum value which is feasible under conditions such as the performance of the inkjet head of the head unit 33 and the like in order to attain high productivity.

When the sheet P is fed to the printing unit 3, the sheet P is transferred by the belt platen 31 at the printing transfer speed Vg. The controller 6 controls the head unit 33 so as to eject ink onto the sheet P which is transferred by the belt platen 31 and to print the image.

When the leading end of the sheet P reaches the switching unit 55, the sheet P is guided to the paper discharge route RD by the switching unit 55. The sheet P which has been printed and which has been guided to the paper discharge route RD is transferred by the paper discharge roller pairs 57 and is discharged onto the paper receiving tray 59.

When the sheets P of the number corresponding to a designated number of sheets are discharged, the controller 6 stops the operations of the belt platen 31 and the paper discharge roller pair 57. Thereby, a simplex printing operation is completed.

Next, a printing schedule during duplex printing will be described.

The printing schedule of the printing unit 3 during duplex printing is for realizing the productivity per one side which is equivalent to the productivity during simplex printing, by an interleaf control system. The interleaf control system is a system that printing is alternately performed on one surface (a front surface) of one sheet P on which printing is not yet performed and a non-printed surface (a back surface) of another sheet P after simplex printing while transferring the plurality of sheets P on the transfer route.

Figure 3:
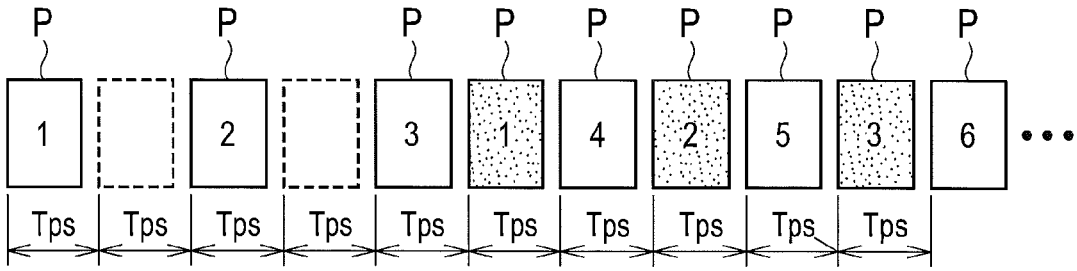
FIG. 3 is an explanatory diagram illustrating a printing schedule during duplex printing.

Specifically, the printing schedule during duplex printing is for alternately performing front-surface printing and back-surface printing at intervals of the print time Tps for single-sheet printing as illustrated in FIG. 3. In FIG. 3, a numeral in each sheet P indicates what the order of that sheet P is. In addition, a blank sheet P indicates that front-surface printing is to be performed on that sheet P and a dot-hatched sheet P indicates that back-surface printing is to be performed on that sheet P.

However, the sheets p are continuously subjected to front-surface printing until the first sheet P after simplex printing is refed to the printing unit 3 and is subjected to back-surface printing. In FIG. 3, a period of time when front-surface printing is being performed on the first to third sheets P corresponds to a period of time when front-surface printing is continuously performed. In this period of time, an idle time corresponding to the print time Tps for single-sheet printing is generated between printing on the preceding sheet P and printing on the succeeding sheet P.

In addition, after front-surface printing of the last sheet P, back-surface printing is continuously performed. In FIG. 3, a period of time when back-surface printing is performed on the sixth and succeeding sheets P corresponds to a period of time when back-surface printing is continuously performed. Also in this period of time, the idle time corresponding to the print time Tps for single-sheet printing is generated between printing on the preceding sheet P and printing on the succeeding sheet P.

In the interleaf system, substantially, the period of time when front-surface printing and back-surface printing are alternately performed corresponds to a processing target. In FIG. 3, the period of time when back-surface printing is performed on the first to third sheets P is a period of time and at the same time, front-surface printing is performed on the fourth and fifth sheets P is a period of time when the productivity per one side which is equivalent to the productivity during simplex printing is realized by the interleaf system. In this period of time, the productivity per one side which is equivalent to the productivity during simplex printing is realized.

The number of sheets (three sheets in the example in FIG. 3) continuously subjected to front-surface printing until the first sheet P is refed to the printing unit 3 and is subjected to back surface printing, is determined in accordance with the sheet size (the sheet length Lp).

Next, the operation of the printing machine 1 during duplex printing will be described.

First, the controller 6 causes the belt platen motor 32 to start driving of the belt platen 31. The controller 6 performs control such that the transfer speed of the sheet P by the belt platen 31 reaches the printing transfer speed Vg.

Furthermore, the controller 6 causes the intermediate transfer motor 47 and the paper discharge motor 58 to start driving of the two intermediate transfer roller pairs 46 and the three paper discharge roller pairs 57. The controller 6 performs control such that the transfer speed of the sheet P by the intermediate transfer roller pairs 46 reaches the printing transfer speed Vg.

Moreover, the controller 6 causes the reversal motor 49 to start normal rotation driving of the reversal roller pair 48. The controller 6 performs control such that the transfer speed of the sheet P by normal rotation driving of the reversal roller pair 48 reaches the printing transfer speed Vg.

In addition, the controller 6 causes the two horizontal transfer motors 51 to start driving of the four horizontal transfer roller pairs 50. The controller 6 performs control such that the transfer speed of the sheet P by the horizontal transfer roller pairs 50 reaches the circulation transfer speed Vr.

As the circulation transfer speed Vr, a value which has been calculated such that it is possible to refeed the sheet P after simplex printing at a timing corresponding to the above-mentioned printing schedule during duplex printing is set. The circulation transfer speed Vr fluctuates depending on the sheet size (the sheet length Lp).

Next, the controller 6 controls the paper feed unit 2 so as to feed the non-printed sheet P at a timing when a time interval between paper feed timings of the respective sheets P reaches twice the time interval (that is, the print time Tps) between paper feed timings in simplex printing. Namely, the controller 6 controls the paper feed unit 2 so as to feed the non-printed sheets P at intervals of 2Tps.

When the non-printed sheets P is fed to the printing unit 3, the sheet P is transferred by the belt platen 31 at the printing transfer speed Vg. The controller 6 controls the head unit 33 so as to eject ink onto one surface (the front surface) of the sheet P transferred by the belt platen 31 and to print the image on the front surface of the sheet P.

When the leading end of the sheet P reaches the switching unit 55, the sheet P is guided to the circulation route RC by the switching unit 55. The sheet P which has been guided to the circulation route RC after simplex printing is transferred by the intermediate transfer roller pair 46 in the intermediate transfer unit 41 of the circulation transfer unit 4, at the printing transfer speed Vg. When the leading end of the sheet P reaches the reversal roller pair 48, the sheet P is transferred by the reversal roller pairs 48 and the intermediate transfer roller pairs 46, at the printing transfer speed Vg.

Figure 4:
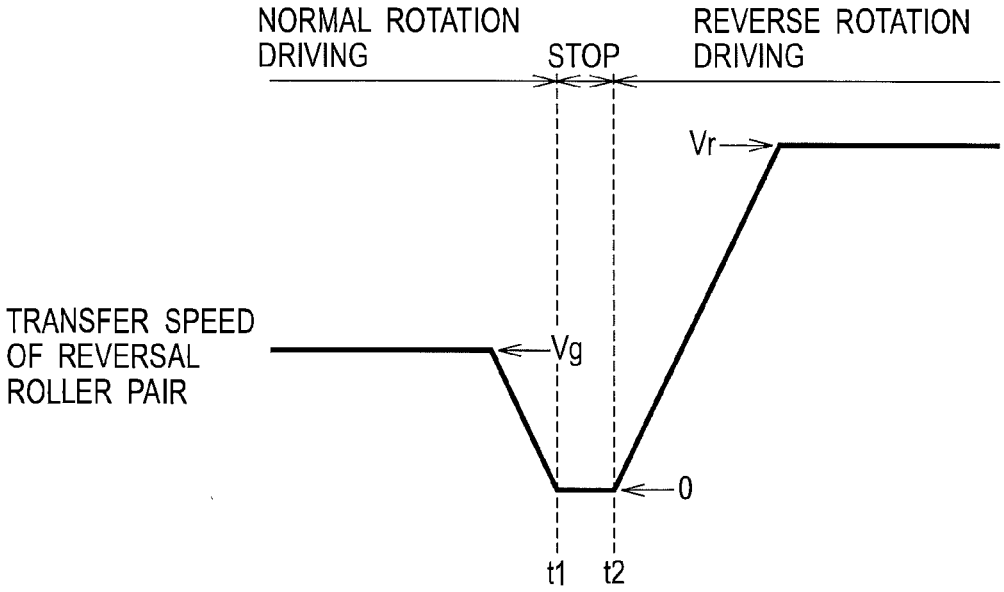
FIG. 4 is a diagram illustrating transition of a transfer speed of a sheet when being switched back by a reversal roller pair.

After the trailing end of the sheet P has slipped out from the downstream side intermediate transfer roller pair 46, the controller 6 stops the reversal roller pairs 48 as illustrated in FIG. 4. Here, the controller 6 performs control such that the reversal roller pair 48 is brought into a state of nipping the sheet P at a position of a trailing end remaining amount Ls from the trailing end of the sheet P, in the transfer direction when the reversal roller pair 48 is driven to normally rotate at a time t1 when the reversal roller pair 48 is stopped. The trailing end remaining amount Ls has a constant value not depending on the sheet length Lp.

When a predetermined temporary stop time elapses after the reversal roller pair 48 has been stopped, the controller 6 causes the reversal motor 49 to start reversal rotation driving of the reversal roller pair 48 at a time t2. Thereby, the sheet P begins to be transferred toward the horizontal transfer roller pairs 50.

The controller 6 performs control such that the transfer speed of the sheet P by the reversal roller pair 48 reaches the circulation transfer speed Vr before the leading end of the sheet P reaches the most-upstream horizontal transfer roller pair 50. Thereby, the sheet P reaches the most-upstream horizontal transfer roller pair 50 at the circulation transfer speed Vr. When the transfer speed of the sheet P by the reversal roller pair 48 reaches the circulation transfer speed Vr, the controller 6 performs control so as to maintain the circulation transfer speed Vr.

When the leading end of the sheet P reaches the most-upstream horizontal transfer roller pair 50, the sheet P is transferred by the horizontal transfer roller pair 50 and the reversal roller pair 48, at the circulation transfer speed Vr. When the trailing end of the sheet P slips out from the reversal roller pair 48, the controller 6 stops reverse rotation driving of the reversal roller pair 48 and then starts normal rotation driving of the reversal roller pair 48 at the printing transfer speed Vg.

Before the sheet P which is transferred by the horizontal transfer roller pairs 50 reaches the vertical transfer roller pair 18, the controller 6 causes in advance the vertical transfer motor 19 to drive the vertical transfer roller pair 18 at the circulation transfer speed Vr. When the leading end of the sheet P reaches the vertical transfer roller pair 18, the sheet P is transferred by the vertical transfer roller pair 18 and the horizontal transfer roller pairs 50, at the circulation transfer speed Vr.

Then, the controller 6 controls the vertical transfer roller pair 18 so as to decelerate the sheet P and to stop the operation by abutting the leading end of the sheet P on the registration roller pair 20. After the vertical transfer roller pair 18 has been stopped, the controller 6 causes the registration motor 21 to start up the registration roller pair 20 at a predetermined timing according to the printing schedule and performs control so as to send the sheet P from the registration roller pair 20 to the belt platen 31. Thereby, the sheet P after simplex printing is refed to the printing unit 3.

Since the sheet P after simplex printing is switched back by the reversal roller pair 48, refeeding is performed with its not-printed surface (the back surface) facing upward. The sheet P after simplex printing, which has been refed, is transferred by the belt platen 31 at the printing transfer speed Vg in the printing unit 3. The controller 6 controls the head unit 33 so as to eject ink onto the not-printed surface of the sheet P transferred by the belt platen 31 and to print the image.

When the leading end of the sheet P reaches the switching unit 55, the sheet P is guided to the paper discharge route RD by the switching unit 55. The sheet P after duplex printing, which has been guided to the paper discharge route RD, is transferred by the paper discharge roller pair 57 and is discharged onto the paper receiving tray 59.

When the sheets P of the number corresponding to the designated number of sheets are discharged, the controller 6 stops the belt platen 31, the intermediate transfer roller pairs 46, the reversal roller pair 48, the horizontal transfer roller pairs 50 and the paper discharge roller pairs 57. Thereby, a duplex printing operation is completed.

As described above, in the printing machine 1, the reversal roller pair 48 of the reversing unit 42 switches back the sheet P and reverses the sheet P upside down, and the sheet P is accelerated up to the circulation transfer sped Vr by acceleration when sheet transfer is restarted after a temporary stop in the switchback operation. Thereby, it is possible to accelerate the sheet P without pulling out the sheet P from the roller pair in the low-speed section by the roller pair in the high-speed section. Consequently, it is possible to reduce the load on the sheets P and the sheet transfer mechanism such as the roller pairs. In addition, since the sheets P are not rubbed with the rollers, it is possible to reduce stains on the sheets P.

Furthermore, since acceleration to the circulation transfer speed Vr is started at the time of restarting transfer after the temporary stop in the switchback operation by the reversal roller pair 48, the length of the route along which sheet transfer is performed by acceleration and at the circulation transfer speed Vr becomes constant not depending on the sheet size. Thereby, it is possible to reduce the length of the transfer route in the printing machine 1 and to miniaturize the main body of the printing machine 1. In addition, it is possible to eliminate necessity of excessively increasing the transfer speed of the sheet P.

Moreover, in the printing machine 1, the sheet P is switched back and is accelerated up to the circulation transfer speed Vr, by the single reversal roller pair 48. Therefore, it is possible to suppress the load on driving sources (the motors) in order to accelerate the sheet P.

The present invention is not limited to the above-mentioned embodiment as it is and constituent elements can be modified and embodied within a range not deviating from the gist thereof in the implementation phase. In addition, it is possible to form various inventions by appropriately combining together the plurality of constituent elements disclosed in the above-mentioned embodiment. For example, some constituent elements may be deleted from all of the constituent elements described in the embodiment.

In addition, for example, each of the functions and the processing described above can be implemented by one or more processing circuits. The processing circuits include a programmed processor, an electric circuit and the like and further include devices such as an integration circuit (ASIC) for specific application, circuit constituent elements arranged so as to execute the described functions, and the like.

The present application claims the priority based on Japanese Patent Application No. 2015-068103 filed on Mar. 30, 2015 and the entire content of the present patent application is incorporated herein by reference.

INDUSTRIAL APPLICABILITY

According to the present invention, the reversing unit accelerates the sheet up to the circulation transfer speed which is higher than the printing transfer speed at the time of restarting transfer after the temporal stop in the switchback operation. Thereby, it is possible to accelerate the sheet without pulling out the sheet from the roller pair in the low-speed section by the roller pair in the high-speed section. Consequently, it is possible to reduce the load on the sheets and the sheet transfer mechanism such as the roller pairs.

REFERENCE SIGNS LIST

1 printing machine
2 paper feed unit
3 printing unit
4 circulation transfer unit
5 paper discharge unit
6 controller
11 external paper feed tray
12 external paper feed roller pair
13 internal paper feed tray
14 internal paper feed roller pair
15 internal paper feed motor
16 internal paper feed transfer roller pair
17 internal paper feed transfer motor
18 vertical transfer roller pair
19 vertical transfer motor
20 registration roller pair
21 registration motor
31 belt platen
32 belt platen motor
33 head unit
41 intermediate transfer unit
42 reversing unit
43 horizontal transfer unit
46 intermediate transfer roller pair
47 intermediate transfer motor
48 reversal roller pair
49 reversal motor
50 horizontal transfer roller pair
51 horizontal transfer motor
55 switching unit
56 solenoid
57 paper discharge roller pair
58 paper discharge motor
59 paper receiving tray

What is claimed is:

1. A printing machine, comprising:

a printer which performs printing while transferring a sheet at a printing transfer speed, a circulation receiver which receives the sheet after simplex printing and transfers the sheet and inverts the sheet upside down, during duplex printing, and a paper refeeder which refeeds, to the printer , the sheet transferred by the circulation receiver after the simplex printing, wherein the circulation receiver includes a reverser which receives the sheet at the printing transfer speed, inverts the sheet upside down by switching back the sheet and accelerates the sheet up to a circulation transfer speed which is higher than the printing transfer speed when sheet transfer is restarted after a temporal stop for a predetermined time period during the switching back, the reverser changing the sheet speed from the printing transfer speed to the circulation transfer speed without increasing the sheet speed during a period after the simplex printing is performed by the printer and up to a time when the sheet reaches a location of the temporal stop, and a high-speed sheet transferer which transfers the sheet switched back by the reverser, at the circulation transfer speed.

2. The printing machine according to claim 1, wherein the reverser switches back the sheet and accelerates the sheet up to the circulation transfer speed, by a single roller pair.

* * * * *